United States Patent [19]

Foster et al.

[11] 4,026,370

[45] May 31, 1977

[54] DRIVING TOOLS

[75] Inventors: Keith Foster, Birmingham, England; Philip Smith, Glasgow, Scotland

[73] Assignee: Secretary of State for Industry in Her Britannic Majesty's Government of the United Kingdom of Great Britain & Northern Ireland, London, England

[22] Filed: Apr. 2, 1975

[21] Appl. No.: 564,624

[30] Foreign Application Priority Data

Apr. 3, 1974 United Kingdom ..... 14888/74

[52] U.S. Cl. ..... 175/20; 173/103; 175/56; 92/75; 173/37

[51] Int. Cl.[2] ..... E21B 11/02

[58] Field of Search ..... 173/14, 116, 101, 102, 173/103, 135, 114, 134, 137; 175/19, 20, 56, 116, 119, 134, 132; 91/308, 217; 92/75, 63; 60/618, 706; 61/53.5

[56] References Cited

UNITED STATES PATENTS

| | | | |
|---|---|---|---|
| 2,748,751 | 6/1956 | Johnson | 173/112 X |
| 2,758,575 | 8/1956 | Wampach | 173/134 X |
| 3,262,507 | 7/1966 | Hansen | 175/56 |
| 3,529,681 | 9/1970 | Berrie | 173/116 |
| 3,650,335 | 3/1972 | Lee et al. | 173/132 X |
| 3,721,095 | 3/1973 | Chelminski | 175/19 |
| 3,833,069 | 9/1974 | Back | 173/134 X |
| 3,847,230 | 11/1974 | Blomquist | 61/53.5 |
| 3,896,701 | 7/1975 | Crewse | 173/137 X |

*Primary Examiner*—Ernest R. Purser
*Assistant Examiner*—Richard E. Favreau
*Attorney, Agent, or Firm*—Cameron, Kerkam, Sutton, Stowell & Stowell

[57] ABSTRACT

A hydraulically actuated driving tool is provided with a ground engageable member which is driven into the ground by the action and reaction of a drive mass which is free to slide within the tool and which is repetitively forced away from and back to the ground engageable member in a manner determined by a hydraulic control system. Each repeated cycle of operation engenders two separate forces to drive the ground engageable member into the ground, one being the force exerted by high pressure fluid in the hydraulic control system when the drive mass is forced away from the ground engageable member and the other being the force exerted when the drive mass impacts back upon the ground engageable member. A switch means is provided whereby the returning drive mass initiates the next cycle of operation of the hydraulic control system.

10 Claims, 6 Drawing Figures

DRIVING TOOLS

This invention relates to hydraulically operated driving tools that may particularly be used to drive a ground engageable member such as a hollow tube into the ground for example to produce a cored sample of the soil.

The present invention is directed towards providing a driving tool that will drive a ground engageable member into different sorts of ground having varying degrees of resistance to penetration.

Accordingly the driving tool of the invention comprises a moveable drive mass slidably located within the tool, a ground engageable member located at one end of the tool, piston means operable upon the drive mass, a hydraulic control system to supply repeated hydraulic pulses, said pulses being operable upon both the piston and the ground engageable member to move the drive mass and the ground engageable member apart so that, during application of a pulse, the ground engageable member is driven into the ground and the drive mass is driven towards the remote end of the tool, and means for returning the drive mass after cessation of the pulse to impact the ground engageable member to drive it still further into the ground.

Generally the tool will be used in the vertical position with the ground engageable member located at the lower end of the tool, and the drive mass, in this case, will be lifted upward within the tool; the impact force being produced by the drive mass falling under gravity and landing within the tool.

The amount and proportion of the penetration of the ground engageable member caused by the reaction force and by the impact force will depend on the ground conditions. In soft ground a substantial proportion of the penetration may be caused by the reaction force, which proportion may decrease in very hard ground such as rock.

In one arrangement of the invention the means for supplying repeated hydraulic pulses to lift the drive mass comprises a hydraulic control system having a hydraulic switching circuit controlled by the position of the drive mass within the tool. Preferably the hydraulic switching circuit is operated by the drive mass each time the drive mass is about to impact at the end of its fall, so that the frequency of impacts is the same as the frequency of the reaction forces of the pulses.

The hydraulic control system comprises a hydraulic switching circuit which controls a main valve to alternately open and close a pressurised hydraulic supply to the control system outlet to produce repeated hydraulic pulses, the main valve being controlled by the position of a reciprocating pilot valve, to one side of which hydraulic pulses produced by the main valve are applied via an orifice, and to the other side of which is applied a control pressure, the movement of the reciprocating pilot valve being controlled by the force of the control pressure at the said other side of the pilot valve and by the force produced by each pulse on the said one side of the pilot valve.

Preferably in the drive tool according to the present invention the repeated hydraulic pulses are applied via the control system outlet to a drive sub-piston, slidably mounted in the tool, which sub-piston is operatively connected to the drive mass to move the drive mass during each hydraulic pulse.

The control pressure may be applied to the other side of the pilot valve via a push rod operatively connected between the said other side of the pilot valve and the drive mass, and arranged so that each time the drive mass is about to impact it operates the push rod to produce a control pressure at the said other side of the pilot valve to move the pilot valve.

One embodiment of the invention will now be described by way of example only, with reference to the accompanying drawings, of which:

FIG. 1 is a broken, part sectioned outside view of a soil sampling tool that can be controlled remotely, for example, to extract a sample from the sea bed, FIG. 2 is divided into two parts, FIG. 2*a* and FIG. 2*b*, which depict an enlarged sectional representation illustrating the hydraulic control system for supplying repeated hydraulic pulses in the sampling tool illustrated in FIG. 1, and FIGS. 3, 4 and 5 are displacement/time graphs showing expected typical penetrations during one cycle of operation of the sampling tool in soft, moderately hard and very hard ground, respectively.

The sampling tool illustrated in FIG. 1 comprises a hollow cylindrical outer casing 36 having an end plate closure 88 at the upper end of the tool. A cylindrical drive mass 89 is slideably located within the casing 36, and has a hollow cylindrical axial recess 39 in its lower face.

The hydraulic control system 40 (detailed in FIG. 2) is located within a valve housing block 2 having an upper flange 84 which is bolted to a corresponding flange 41 at the lower end of the outer casing 36. A sample tube 42 having four tapering longitudinal flanges 44 welded at 90° intervals around the circumference is fixed to a tube clamp 43 by means of two clamp bolts 45, 46 clamping onto respective diametrically opposite flanges 44 on the sample tube 42.

The cylindrical valve housing block 2 (FIG. 2) within which the hydraulic control system 40 is located, has two axial valve housing bore holes 47, 48 extending from the upper to the lower face of the housing block 2, ie from the right to the left hand face of the housing block 2 as viewed in FIG. 2.

A cylindrical main valve block 49 having a main valve bore 4, and a cylindrical pilot valve block 50 having a pilot valve bore 5, are fixed in the bore holes 47, 48 respectively. The main valve bore 4 is stepped at 80 and has a cylindrical main valve 6 slideably located therein, and the pilot valve bore 5 has a pilot valve 10 slideably located therein.

The lower face of the valve housing block 2 has an end plate 11 which seals off the lower end of the main valve bore hole 4. A cylindrical sub-piston sleeve 51, located against the upper face 52 of the valve housing block 2, has, throughout its length, a wide diameter bore 53 coaxial with the main valve bore 4 and a parallel narrow diameter bore 54 coaxial with the pilot valve bore 5. A drive sub-piston 55 and control push rod 56 are respectively slideably located in the wide and narrow diameter bores 53, 54 of the sub-piston sleeve 51. The main valve 6 has a narrow diameter solid cylindrical stem 12 at its lower end which is slideably located in a hole 13 in a main valve bore end plug 68, and has a step 80 between two hollow portions 14, 15 having respective external diameters equal to the respective internal diameters of the stepped main valve bore 4. At the step 80 of the main valve 6, a circumferential groove 17 is formed in the surface of the main valve bore 4.

When the main valve 6 is in a position illustrated in FIG. 2, an annular cavity 18 is formed in the main valve bore 4 around the solid stem 12 of the main valve 6, bounded by the main valve end plug 68 and the valve 6. The cavity 18 communicates with a hollow bore 19 of the portions 14, 15 of the main valve 6 via ports 20 at the lower end of the main valve 6. The large diameter portion 14 of the valve 6 has radial ports 21, and the small diameter stepped portion 15 has radial ports 22, between the hollow bore 19 of the main valve 6 and the surface of the main valve bore 4.

The pilot valve 10 comprises two pistons 23, 24 slideably located in the pilot valve bore 5 and rigidly fixed together but spaced apart to form an annular space 25 therebetween. A third, pilot valve control piston 57 is fixed to the upper side of the pilot valve 10 and makes contact at a control pressure outlet 90 with the lower end of the control push rod 56. When the pilot valve 10 is in the position illustrated in FIG. 2, the annular space 25 is open to the groove 17 in the bore 4 via ports 27 in the pilot valve block 50, circumferential groove 58 around the bore hole 48 in the housing block 2, angled bore 59 in the block 2, circumferential groove 60 around the bore 47 in the block 2 and bored 61 in the main valve block 49.

The angled bore 59, although shown for convenience in FIG. 2 as lying in the same plane as the axes of the pilot valve and main valve bores, in fact lies on a different plane at an acute angle to the plane containing the axes of the pilot and main valve bores. The bore 59 communicates directly between the circumferential grooves 60 and 58, and extends to the outer surface of the housing block 2 where it is plugged by a plug 85.

The annular space 25 is also open to the wide diameter portion of the main valve bore hole 4 via ports 37 in the piot valve block 50, circumferential groove 62 and bore 63, and circumferential groove 64 in the housing block 2, and via port 34 and circumferential groove 65 in the main valve block 49. A high pressure inlet line 31 illustrated by the broken line in FIG. 2 communicates with the circumferential groove 64 to supply high pressure to the bore 47 and a low pressure outlet line 70 communicates with the pilot valve bore in the housing block 2 via circumferential groove 72 in the bore 48.

An auxiliary high pressure line 67 communicates between a cavity 33 formed between the end plate 11 and main valve plug 68, and the high pressure line 31, via a plugged bore 86 and circumferential groove 64 in the housing block 2. The cavity 33 communicates with the slid stem 12 of the pilot valve 10, via the hole 13 in the end plug 68.

When the pilot valve 10 is in its uppermost position within the control piston 57 at the upper face 52 of the housing block 2, the low pressure outlet line 70 communicates with the annular space 25 via circumferential groove 72, and ports 28 in the pilot valve block 50, but the high pressure line 31, via circumferential groove 64 and bore 63, will be sealed off from the space 25 by the position of the pilot valve piston 23. In this position the low pressure outlet line 70 communicates with the circumferential groove 17 at the step 80 of the main valve 6 via annular space 25, ports 27 circumferential groove 58, port 59, circumferential groove 60 and bore 61.

When the pilot valve 10 is in a lower position as illustrated in FIG. 2, the high pressure inlet line 31 communicates with the space 25 via circumferential groove 64, bore 63, circumferential groove 62 and bores 37 and hence communicates with circumferential groove 17 at the step 80 of the main valve 6 via ports 27, circumferential groove 58, angled bore 59, circumferential groove 60 and bore 61, and the low pressure line 70 will be cut off from space 25 by the position of the pilot valve piston 24.

A cavity 39 in the bore 5 is formed between the pilot valve piston 23 and an orifice plug 26 at the lower end of the bore 5, and communicates with the cavity 18 in the main valve bore 4 via the orifice plug 26, port 75 in the pilot valve blcok 50, circumferential groove 76, port 77, circumferential groove 78 in the housing block 2, and port 79 in the main valve cylinder block 49.

In operation the tool is used in the vertical position with the sample tube 42 in contact with the ground and a high pressure oil supply is connected to the inlet line 31 and a low pressure outlet is connected to the low pressure outlet line 70. When the drive mass 38 is in its lowermost position with its lower face in contact with the upper face 52 of the housing block 2 and with the recess 89 enclosing the sub-piston sleeve 51, the drive sub-piston 55 and control push rod 56 are in their lowermost position and the pilot valve 10 is in the position illustrated in FIG. 2. In FIG. 2 the low pressure outlet line 70 is cut off from annular space 25 by the pilot valve piston 24 in the bore 5, but the high pressure supply is applied to the step 80 of the main valve bore 4 via the annular space 25, ports 27, circumferential groove 58, angled bore 59, circumferential groove 60 and radial port 61 in the main valve 6.

The area of the annular face at the external step 80 of the portions 14 and 15, constituting the control area of the main valve 6, is greater than the area of the end face of the solid cylindrical stem 12 of the main valve 6, and the high pressure supply acting on the annular control area at the step 80 will cause the main valve 6 to move downwards. Radial ports 21 will then be adjacent ports 34, and the high pressure will be applied via inlet line 31, groove 64, ports 34 and ports 21 to the cavity 19.

The hydraulic pressure pulse generated in the cavity 19 will act on the drive sub-piston 55 which in turn acts on the drive mass 38, giving it an impulse and causing it to move upwards within the outer casing 36. At the same time the reaction of the impulse on the drive mass 38 will be transmitted via the end plate 11 and tube clamp 43 to the sample tube 42, to drive the sample tube 42 into the ground. The high pressure generated in the cavity 19 will act on the upper side of the orifice plug 26 in the pilot valve bore 5 via the ports 20, cavity 18, ports 79, groove 78, port 77 groove 76, ports 75 and the cavity 39. The pressure in the cavity 39 will gradually build up through the orifice plug 26 until the force acting on the lower piston 23 of the pilot valve 10 is sufficient to move the pilot valve 10 and push rod 56 upwards, as the drive mass 38 will still be moving upwards under the action of the pulse in the cavity 19.

Upward movement of the pilot valve 10 causes the high pressure inlet line 31 to be cut off from the space 25 by the piston valve 23 and will open the low pressure outlet line 70 to the space 25. Hence the high pressure is cut off from the step 80 in the main valve 6, and high pressure via the auxiliary high pressure line 67 and the cavity 33 in the main valve bore 4, acts on the lower face of the solid stem 12 of the main valve 6 to move the main valve upwards. The main valve 6 will thus return to the position shown in FIG. 2, and the high pressure supply from the inlet line 31 will be cut off from the bore 19, to stop the pulse.

As the main valve returns to the position shown in FIG. 2 the radial ports 22 open the cavity 19 to the low pressure outlet line 70 via groove 81, ports 30, groove 71, bore 83 and groove 72 in the housing block 2. Also low pressure will be applied to the lower side of the orifice plug 26 in the pilot valve bore 5, from the ports 20 and cavity 18 in the main valve 6 and high pressure in the cavity 39 will gradually be relieved through the orifice plug 26.

After the duration of the pulse the drive mass 38 will slow down within the outer casing 36 and then fall under the action of gravity and impact onto the upper face 52 of the housing block 2 to impart an impact force via the tube clamp 43 onto the sample tube 42 to drive the sample tube further into the ground.

As the drive mass 38 falls under gravity and immediately before it impacts on the housing block 2 the control push rod 56 will be forced downwards, by the falling drive mass 38 and the pilot valve 10 will return to the position illustrated in FIG. 2, the low pressure outlet line 70 being cut off from, and the high pressure inlet line 31 being open to, the space 25.

High pressure will be supplied to the circumferential groove 17 at the step 80 of the main valve 6, causing the valve 6 to move downwards and the high pressure to be supplied to the cavity 19 via the port 34 in the main valve block 50 and ports 21 in the main valve 6.

A pulse of pressure will move the drive mass 38 vertically up the outer casing 36, producing a reaction force on the sample tube 42, and a repeated cycle of hydraulic pulses will be produced.

The commencement of each pulse is controlled by the downward return movement of the control push rod 56, which is operated by the drive mass immediately before it impacts on the housing block 2, so that during each cycle of operation there will always be a single reaction force and a single impact force acting to drive the sample tube 42 into the ground.

The rate at which the pilot valve 10 moves upwards under the action of the high pressure on the lower face of the piston 23 and hence the duration of each hydraulic pulse in the cycle of operation is a function of the size of restriction in the orifice plug 26 which restricts the flow in both directions between the cavities 18 and 39; the smaller the size of the restriction the longer will be the build up of pressure in the cavity 39 during the pulse and the longer will be the duration of the pulse. The orifice plug 26 may be replaced by a variable restriction orifice of any convenient type so that the size of the restriction can be readily altered preferably without stopping the operation of the tool.

The relative driving force exerted by the reaction force and the impact force will depend on the condition of the ground into which the sample tube is being driven. A larger portion of the penetration of the sample tube caused by the reaction pulse will often occur in soft soil than in hard soil such as rock.

FIG. 3 shows a displacement/time curve of what may be expected to be a typical penetration during one pulse cycle of a sample tube in soft ground. The displacement of the drive mass is shown by the full line of the graph, and the total ground penetration of the sampler tube is shown by the broken line. The origin of the graph represents the commencement of a pulse, at zero ground penetration of the core sampler. During the period of the pulse T*p* the resultant reaction force causes the sampler tube to penetrate the soft ground by the amount D*r*3 shown. During the same period the drive mass has moved vertically upwards, and at the end of the pulse, T*p*, it starts to decelerate under the action of gravity and subsequently falls to impact at the end of cycle time T. The total penetration D3 of the sampler tube in the soft ground is made up of a substantial reaction force penetration D*r*3 and a smaller impact force penetration D*i*3.

Figure 1:
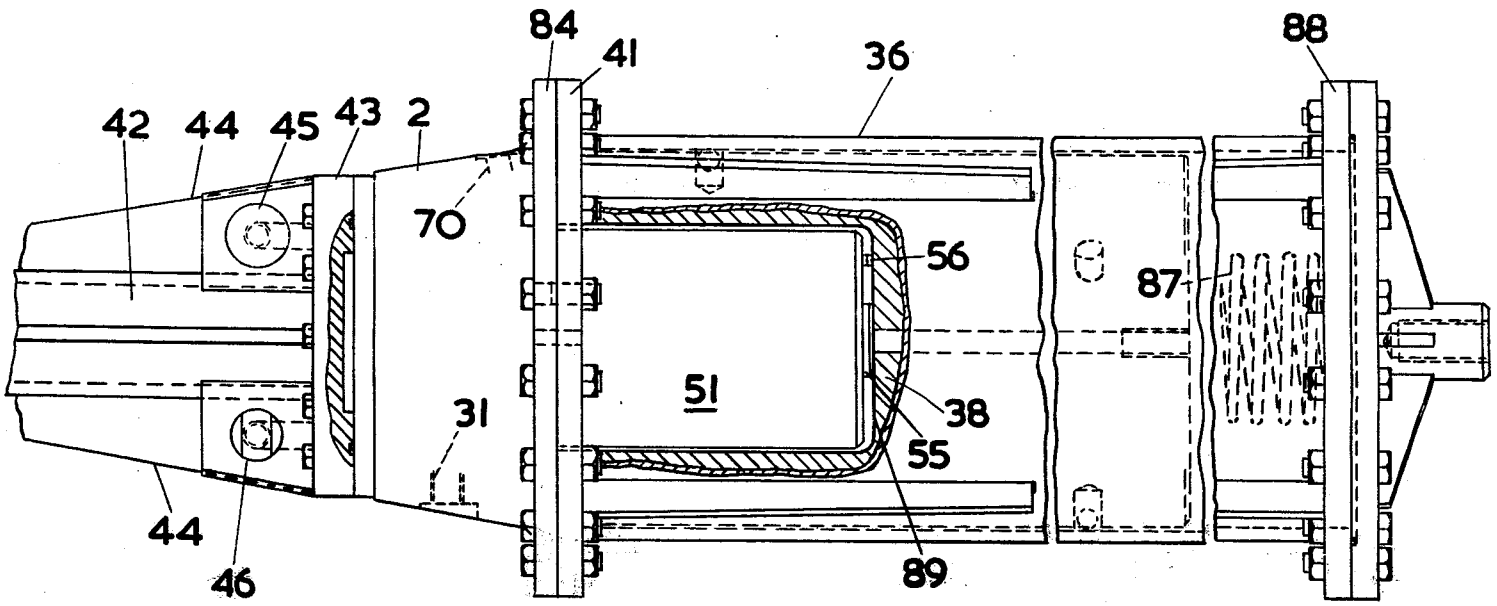
Figure 2A:
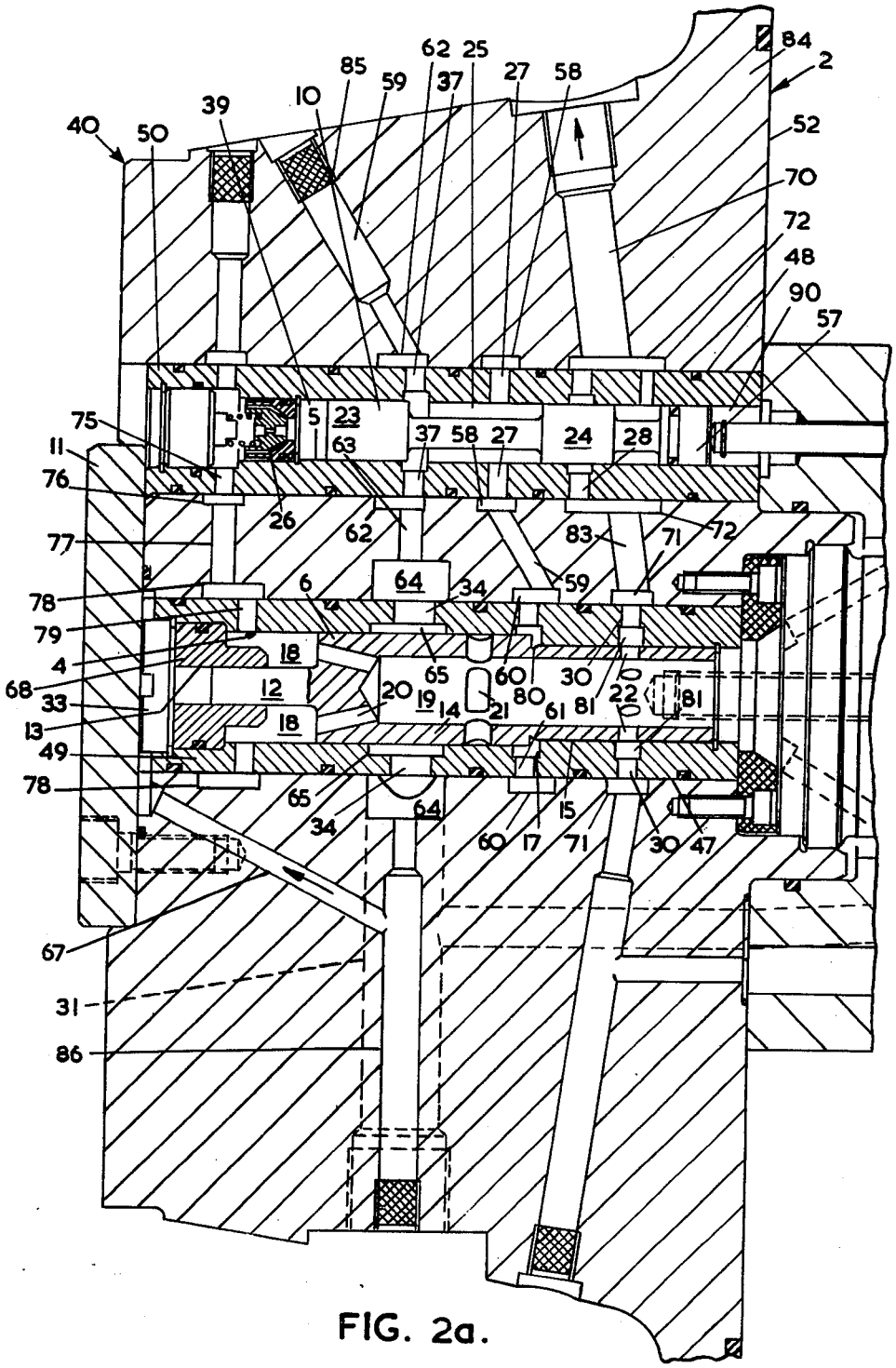
Figure 2B:
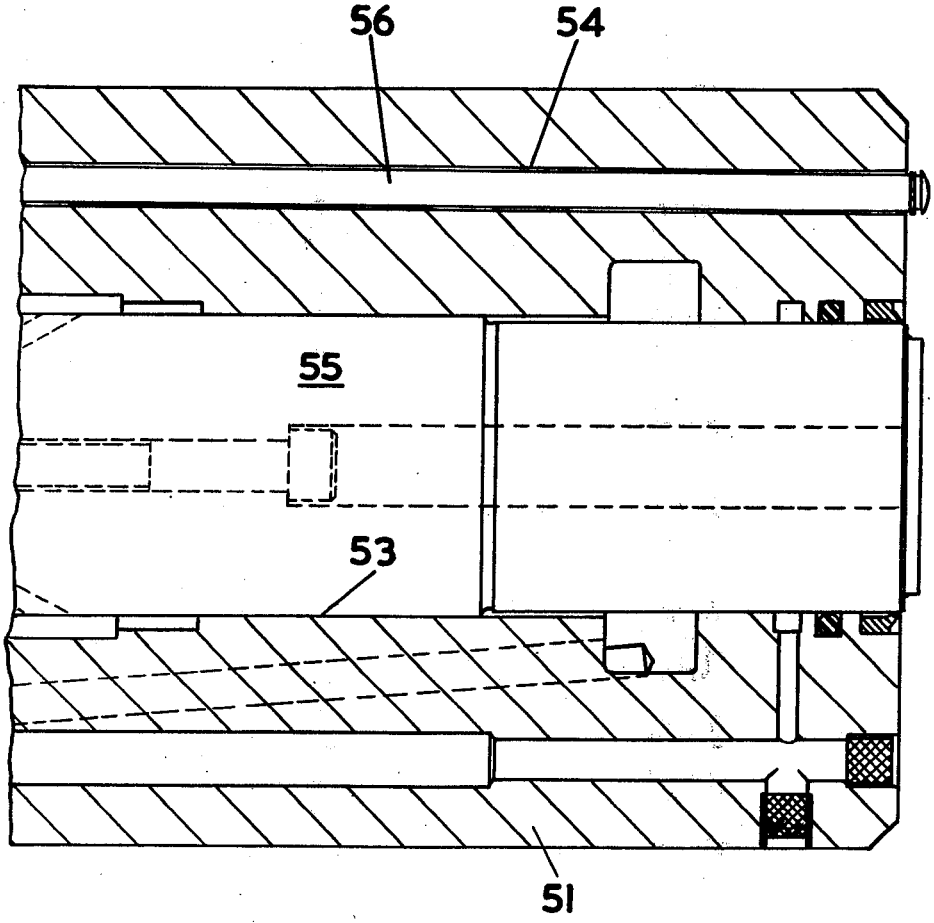
Figures 3, 4, 5:
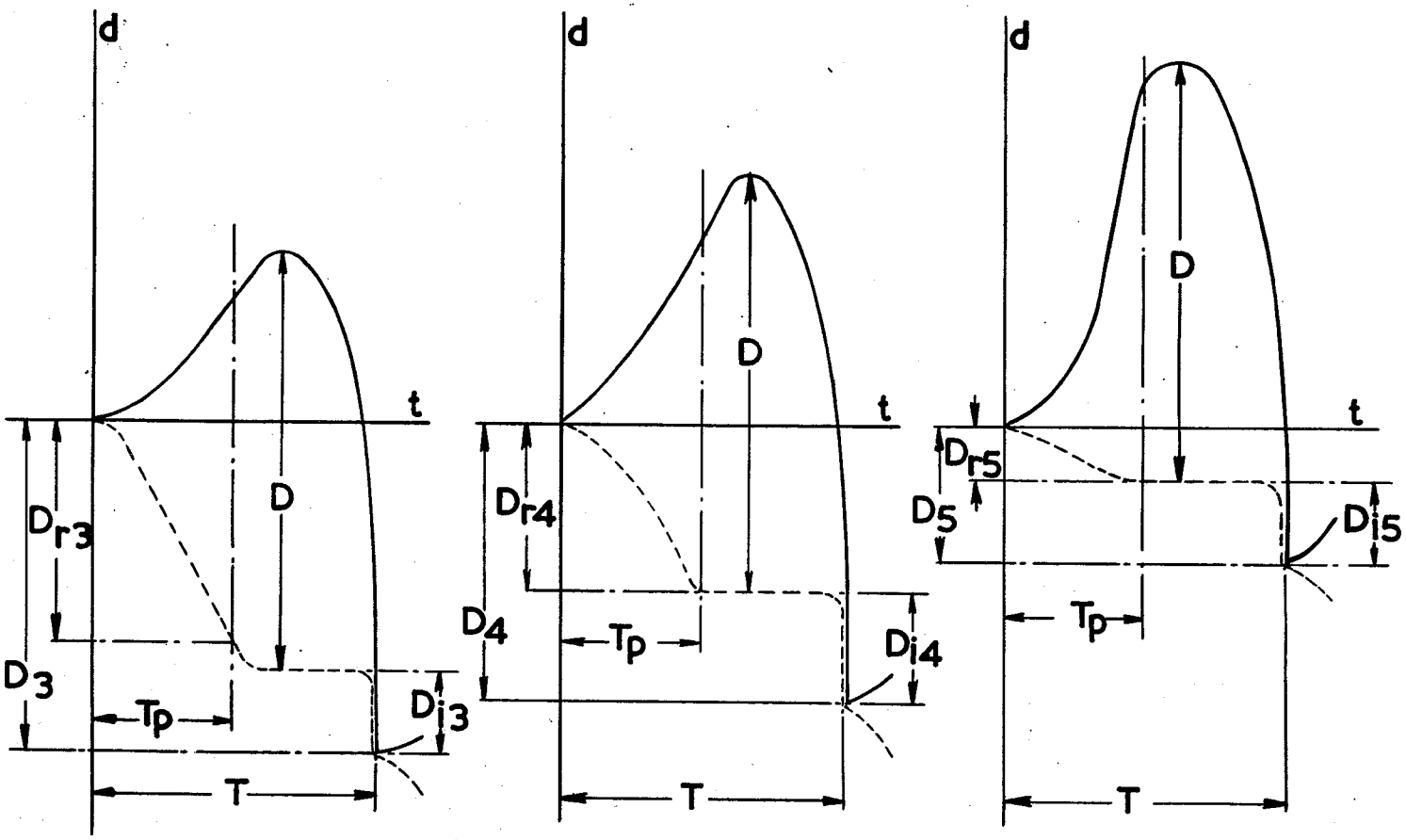
FIG. 4 shows a similar displacement/time curve of a typical penetration of the tool in harder ground. It will be seen that during each cycle the total penetration D4, consisting of reaction force penetration D*r*4 and impact force penetration D*i*4 is less than in softer ground, but the cycle time T and the pulse time T*p* is expected to be unaffected by the ground resistance.
FIG. 5 shows the displacement/time characteristics of a typical penetration of the tool in very hard ground such as rock. The total penetration D5 is considerably less than in softer ground, the impact force producing a substantial proportion D*i*5 of the total penetration D5.

Generally the maximum displacement D of the drive mass 38 relative to the housing block 2 is unrelated to the ground resistance, and is therefore approximately constant in each of the FIGS. 3, 4 and 5. Similarly the force of impact is independent of ground resistance.

In the driving tool described and illustrated, the reaction force is most effective in soft ground and in very hard ground the impacting force will be proportionally more effective. The respective penetration caused by the reaction and impact forces if therefore at least to a certain extent governed by the degree of resistance of the ground to penetration by the tool.

The driving tool described and illustrated is designed to be used in the upright position and the impact of the drive mass is caused by the drive mass falling under gravity and impacting within the tool. However a compression spring (87) or other means may be located within the tool to act on the drive mass and cause it to impact in the tool, so that the tool could be used in other than the upright position.

We claim:

1. A driving tool comprising a casing having an axis intended for use in a vertical position; a housing block having an upper and a lower face, the upper face being attached to the lower end of said casing; a ground engageable member attached to the lower face of said housing block; a drive mass freely slideable within said casing along said axis and having a lower face which is coactable with the upper face of said housing block for driving said housing block and said ground engageable member downwardly; a piston, slideable on said axis and captive within an open-ended axial sleeve extending from the upper face of said housing block into said casing and intrudable into a corresponding recess in the lower face of said drive mass, said piston being coactable with said drive mass for projecting said drive mass away from said housing block upwardly within said casing; and a hydraulic control system within said housing block for generating from a constant pressurised fluid supply repeated hydraulic pulses each operative upon said piston for driving said piston upwardly within said axial sleeve thereby impacting said drive mass, whereupon said drive mass slides upwardly in said casing until all upward momentum is expended and thereafter falls downwardly within said casing finally impacting said housing block.

2. A driving tool as claimed in clam 1 in which the ground engageable member comprises a hollow tube for removing a sample core from the engaged ground.

3. A driving tool as claimed in claim 1 in which the hydraulic control system comprises an inlet for (a) the pressured fluid supply, a reciprocatable pilot wave, a main valve which is actuatable by the pilot valve to alternately connect and disconnect the pressurised fluid supply for operation on the piston, an outlet for the repeated hydraulic pulses generated by operation of the main valve and an orifice through which the hydraulic pulses are also supplied to one side of the pilot valve, the other side of which valve is subjected to a control pressure so that movement of the said pilot valve is differentially controlled by the force exterted by each hydraulic pulse on the said one side of the pilot valve and the force exerted by the control pressure at the said other side of the pilot valve.

4. A driving tool as claimed in claim 3 incorporating a push-rod which is operatively connected to the pilot valve and engageable with the drive mass, for switching said pilot valve when said drive mass is about to impact the housing block.

5. A driving tool as claimed in claim 3 in which the orifice through which said repeated hydraulic pulses are supplied to the pilot valve, is a variable restriction device whereby the duration of each hydraulic pulse and hence the frequency of operation of the driving tool can be varied.

6. A driving tool comprising a casing having an axis suitable for use in any position inclined by up to 90° from vertical and having opposing first and seconds ends; a compression device located within said casing adjacent the first end thereof; a housing block having opposing first and second end-faces, the first end-face being attached to the second end of said casing; a ground engageable member attached to the second end-face of said housing block; a drive mass freely slideable within said casing along said axis and having a first end-face which is coactable with said compression device and an opposing second end-face which is coactable with the first end-face of said housing block for driving said housing block and said ground engageable member along said axis; a piston slideable on said axis and captive within an open-ended axial sleeve extending from the first end-face of said housing block into said casing and intrudable into a corresponding recess in the second end-face of said drive mass, said piston being coactable with said drive mass for projecting said drive mass away from said housing block and along said casing; and a hydraulic control system within said housing block for generating from a constant pressurised fluid supply repeated hydraulic pulses each operative upon said piston for driving said piston within said axial sleeve in a direction towards said drive mass thereby impacting said drive mass, whereupon said drive mass slides away from said housing block and along said casing, strikes said compression device, rebounds along said casing and finally impacts said housing block.

7. A driving tool as claimed in claim 6 in which the ground engageable member comprises a hollow tube for removing a sample core from the engaged ground.

8. A driving tool as claimed in claim 6 in which the hydraulic control system comprises an inlet for the pressured fluid supply, a reciprocatable pilot valve, a main valve which is actuatable by the pilot valve to alternately connect and disconnect the pressurised fluid supply for operation on the piston, an outlet for the repeated hydraulic pulses generated by operation of the main valve and an orifice through which the hydraulic pulses are also applied to one side of the pilot valve, the other side of which valve is subjected to a control pressure so that movement of the said pilot valve is differentially controlled by the force exerted by each hydraulic pulse on the said one side of the pilot valve and the force exerted by the control pressure at the said other side of the pilot valve.

9. A driving tool as claimed in claim 8 incorporating a push-rod which is operatively connected to the pilot valve and engageable with the drive mass, for switching said pilot valve when said drive mass is about to impact the housing block.

10. A driving tool as claimed in claim 8 in which the orifice through which said repeated hydraulic pulses are supplied to the pilot valve, is a variable restriction device whereby the duration of each hydraulic pulse and hence the frequency of operation of the driving tool can be varied.

* * * * *